US006305343B1

(12) United States Patent
Sato et al.

(10) Patent No.: US 6,305,343 B1
(45) Date of Patent: Oct. 23, 2001

(54) DIESEL ENGINE CONTROL ON ENGINE-STOP

(75) Inventors: Hiromi Sato; Katsushi Shidomi, both of Kanagawa (JP)

(73) Assignee: Isuzu Motors Limited, Tokyo (JP)

( * ) Notice: Subject to any disclaimer, the term of this patent is extended or adjusted under 35 U.S.C. 154(b) by 0 days.

(21) Appl. No.: 09/573,538

(22) Filed: May 19, 2000

(51) Int. Cl.[7] ..... F02B 77/00
(52) U.S. Cl. ..... 123/198 DB
(58) Field of Search ..... 123/198 DB, 446, 123/478

(56) References Cited

U.S. PATENT DOCUMENTS 4,597,369 * 7/1986 Yashuhara ..... 123/458
4,924,827 * 5/1990 Minegishi ..... 123/198 DB
5,062,400 * 11/1991 Minegishi et al. ..... 123/198 DB
5,730,098 * 3/1998 Sasaki et al. ..... 123/198 DB

FOREIGN PATENT DOCUMENTS

35241/1983 3/1983 (JP) .
33419/1987 7/1987 (JP) .
41624/1989 2/1989 (JP) .
47382/1993 6/1993 (JP) .

* cited by examiner

*Primary Examiner*—Bibhu Mohanty
(74) *Attorney, Agent, or Firm*—Browdy and Neimark

(57) ABSTRACT

On stopping a diesel engine, an amount of fuel injected on engine-stop control is made reduced slowly after the engine is manipulated to be stopped, thereby suppressing vibration or shock, which might otherwise occur owing to sudden engine stall. With an ignition key as an operating means turned off, an engine control mode enters a mode of beginning the engine-stop control, where an amount of fuel injected on the engine-stop control is selected to reduce slowly with a time that has elapsed since the ignition was off. Thus, the engine is less subject to sudden stall and kept from vibration and shock resulting from the engine-stop. The instant the engine rpm Ne lowers below a preset engine rpm Ne1, an intake-throttle valve control mode starts to throttle an amount of admitted air correspondingly to the reduction of the amount of fuel injected on the engine-stop control, thereby eliminating undesirable burning owing to undue excess-air factor.

10 Claims, 4 Drawing Sheets

DIESEL ENGINE CONTROL ON ENGINE-STOP

BACKGROUND OF THE INVENTION

1. Field of the Invention

The present invention relates generally to a diesel engine control on engine-stop, and particularly to a diesel engine-stop control system that serves to reduce or suppress vibrations liable to occur when stopping the diesel engine.

2. Description of the Prior Art

There have been conventionally known three ways to stop the diesel engine: any system interrupting the flow of fuel to the combustion chamber, a system cutting off the supply of air to the combustion chamber, and a system cutting off both the flows of fuel and air.

In the system cutting off the flow of fuel, turning an ignition key from ON to OFF causes a sudden interruption of the flow of fuel to the combustion chamber. This system has an advantage in which the engine is allowed to come to a halt immediately following the cutoff of fuel. Nevertheless, as fresh air still remains flowing into the combustion chamber, the pressure inside the combustion chamber rises as a piston moves up to top dead center. As a result, when the engine lowering rapidly in rpm comes in matching with the resonance point of the engine, the engine develops violent vibrations, thus providing an uncomfortable ride to the occupants.

In systems cutting off the intake air supply to the combustion chamber, since no fresh air is allowed to enter the combustion chamber, no pressure rise inside the combustion chamber comes into action, thus keeping the engine from becoming violent in vibration. However, the fuel remains injected into the combustion chamber even after the engine has ceased from working, rendering inferior the fuel consumption. In addition, this system has other drawbacks in which it takes a prolonged period of time till the engine stops absolutely, compared with the former system interrupting the flow of fuel and in which a partial vacuum developed in the combustion chamber causes much oil loss into the combustion chamber from the crank case via piston rings, thereby making the combustion chamber so rich in fuel that much smoke is liable to take place in the exhaust emissions from the next combustion cycle. This system, moreover, has a fear of involving the engine in a possible risk in which even if the device to cut off the intake air had trouble, either of fuel and air would remain charged into the combustion chamber, resulting in failure of stopping the engine.

Disclosed in Japanese Patent Publication No. 33419/1987 is a system interrupting either fuel and intake air into the combustion chamber in order to avoid a sudden stop of the engine. In accordance with the disclosed prior engine control system, an intake shut-off valve is first closed prior to bringing the engine to a halt to slow the engine rpm down. Then, a delay circuit such as a relay shuts down the fuel supply to the engine, thereby suppressing the vibrations, which might otherwise happen on stopping the engine.

In the conventional system for stopping the engine disclosed just above, the sudden closure manipulation of the intake shutdown valve results in the abrupt reduction of the engine rpm, thereby still developing a vibratory shock in the engine to possibly provide an uncomfortable ride to the drivers.

In accordance with another prior system for stopping the engine disclosed in Japanese Patent Laid-Open No. 41624/1989, operating the switch to bring the engine to a halt results in interrupting the fuel supply to the combustion chamber. Then, an intake cut-off valve installed in an intake manifold allowing air supply to the combustion chamber is closed in response to a detected condition where the engine rpm has approached a resonance range, thereby providing a high resistance against the reciprocating motion of the piston in the combustion chamber to lower rapidly the engine rpm.

Japanese Utility Model Laid-Open No. 47382/1993 discloses a system to stop the diesel engine, in which the delay control is operated not by electrically but by mechanically. This mechanical delay-control system is composed of a vacuum pump, an intake-air cut-off actuator connected to the vacuum pump via a vacuum tube, a fuel cut-off actuator connected in series with the in take-air cut-off actuator via another vacuum tube, and a solenoid common to both the intake-air and fuel cut-off actuators, which is installed in the former vacuum tube. The intake-air cut-off actuator is arranged closer in distance to the vacuum pump than the fuel cut-off actuator while a suction required in the intake-air cut-off actuator for drawing in air is set large compared with the suction in the fuel cut-off actuator, so that the intake air to the combustion chamber is first cut off, followed by the interruption of the flow of fuel.

Moreover, an intake-air throttle system for the diesel engine is disclosed in Japanese Patent Laid-Open No. 35241/1983, in which an intake throttle valve installed in an intake manifold is controlled to open fully under the loaded operation of the engine, partially in idling and close completely when the engine is stopped.

In the system in which the fuel supply is interrupted with the fuel cut-off valve installed in the fuel line, the operation to stop the engine is a switching operation of two stages of both the supply and the cut-off, and therefore apt to cause vibrations and shocks when the engine is stopped. Moreover, as the fuel cut-off valve is closed following the closure of the intake-air cut-off valve, the possible delay of the closing of the fuel valve allows too much fuel for the admitted air to flow into the combustion chamber, thus causing the major drawbacks of worse fuel consumption as well as much smoke in the exhaust gases. There is yet the problem to be solved in how to reduce gradually the engine rpm when the engine is stopped by the cut-off of the flow of fuel into the combustion chamber.

SUMMARY OF THE INVENTION

A primary object of the present invention is overcome the problem mentioned just above, and in particular to a diesel engine control system on engine-stop, which makes it possible to much reduce vibrations and shocks, which might otherwise occur when the engine is stopped by the closing of a fuel cut-off valve installed in a fuel supply line.

The present invention is concerned with a diesel engine control system on engine-stop, comprising an operating means turned over between an "ON" position where the diesel engine operates and an "OFF" position where the diesel engine stops, sensing means for monitoring diesel engine operating conditions, a fuel-injection mechanism for injecting fuel into a combustion chamber in the diesel engine, a controller for determining an amount of fuel to be injected depending upon the diesel engine operating conditions, wherein the controller has an engine-stop control mode which is functionable after the operating means is turned to "OFF" position, and the controller decreases the amount of fuel to be injected gradually with a time that has elapsed after starting of the engine-stop control mode.

As apparent from the foregoing, according to the engine-stop control system of this invention, the fuel supply does not cease immediately the instance the operating means is turned from "ON" to "OFF", but still continues injecting fuel into the combustion chambers for a preselected interval of time with the amount injected on the engine-stop control mode, which is selected depending on the time elapsed. Especially, even after the ignition key as an operating means has been turned off, the fuel supply does not cease shortly but there is a preselected time delay in cutting off the fuel flow to the combustion chamber, during which the combustion chamber continues charged with an amount of fuel reducing slowly depending on the time that has elapsed since the ignition key was turned off. Thus, slow reduction of the engine rpm is allowed to lessen the vibrations or shocks that would otherwise result from sudden stop occurring conventionally in the diesel engine, so that the driver is kept from the uncomfortable ride.

In an aspect of the present invention, a diesel engine control system on engine-stop is disclosed, wherein an intake-throttle valve is provided in the diesel engine to regulate an amount of air admitted into the combustion chamber, and the controller makes the intake-throttle valve narrower in throttling position gradually with a time that has elapsed after starting of the engine-stop control mode.

In order to slow the engine rpm down shortly after the operating means is turned off, the amount of fuel injected on the engine-stop control mode should be adjusted to a small amount compared with the amount of fuel required on normal engine operation. Thus, if the engine on the engine-stop control were charged with an amount of admitted air that is as much as that of the admitted air for the normal fuel-injection events, the admitted air would become excessive in amount with respect to the fuel injected on the engine-stop control, resulting in worse burning of fuel, and if worst comes to worst, there is much possibility that the engine will come in sudden stall. To cope with this, the intake-throttle valve position is controlled to lower the amount of the admitted air correspondingly to the amount of fuel injected, which is reduced gradually on the engine-stop control mode, thereby reducing slowly the output rpm of the diesel engine.

In another aspect of the present invention, a diesel engine control system on engine-stop is disclosed, wherein the controller finds the amount of air admitted into the combustion chamber in accordance with signals reported from the sensing means, and an actual excess-air factor on the engine-stop control mode on the basis of the amounts of fuel injected and air admitted, thereby controlling the throttling position of the intake-throttle valve to make the actual excess-air factor coincident with a desired excess-air factor that is determined depending on the signals from the sensing means. Although the intake-throttle valve position, even after the operating means has been switched off, is still controlled such that the actual excess-air factor comes into coincidence with the desired excess-air factor, the combustion chamber may be charged with the amount of air metered correspondingly with accuracy to the lowering amount of fuel injected, so that the desired combustion may be ensured till the diesel engine operation ceases completely.

In another aspect of the present invention, a diesel engine control system on engine-stop is disclosed, wherein the controller finds a fundamental desired intake-throttle valve position in accordance with the desired excess-air factor, and a correction amount of the intake-throttle valve position depending on a deviation of the actual excess-air factor from the desired excess-air factor, and further compensates the fundamental desired intake-throttle valve position with the correction amount of the intake-throttle valve position, thereby finding an ultimate desired intake-throttle valve position, on the basis of which is regulated the intake-throttle valve position. That is to say, the intake-throttle valve position is subject to the feedback control on the basis of the deviation of the actual excess-air factor to the desired excess-air factor.

In the feedback control of the intake-throttle valve position, the correction amount of the intake-throttle valve position provided by the controller is expressed as a sum of an integral correction and a proportional correction, which are found depending on the deviation of the actual excess-air factor to the desired excess-air factor.

In a further another aspect of the present invention, a diesel engine control system on engine-stop is disclosed, wherein the controller closes completely the intake-throttle valve when the diesel engine rpm on the engine-stop control mode lowers below a preselected rpm, while maintaining the amount of fuel injected at a fixed value. As the intake-throttle valve is closed completely at the instant the engine rpm on the engine-stop control mode has lowered below the preselected rpm, no more fresh air is charged into the combustion chamber and thus the engine operation ceases moderately.

Other objects and features of the present invention will be more apparent to those skilled in the art on consideration of the accompanying drawings and following specification wherein are disclosed preferred embodiment of the invention with the understanding that such variations, modifications and elimination of parts may be made therein as fall within the scope of the appended claims without departing from the spirit of the invention.

DETAILED DESCRIPTION OF THE PREFERRED EMBODIMENTS

A preferred embodiment of an engine-stop control system for a diesel engine according to the present invention will be explained in detail hereinafter with reference to the accompanying drawings.

Figure 4:
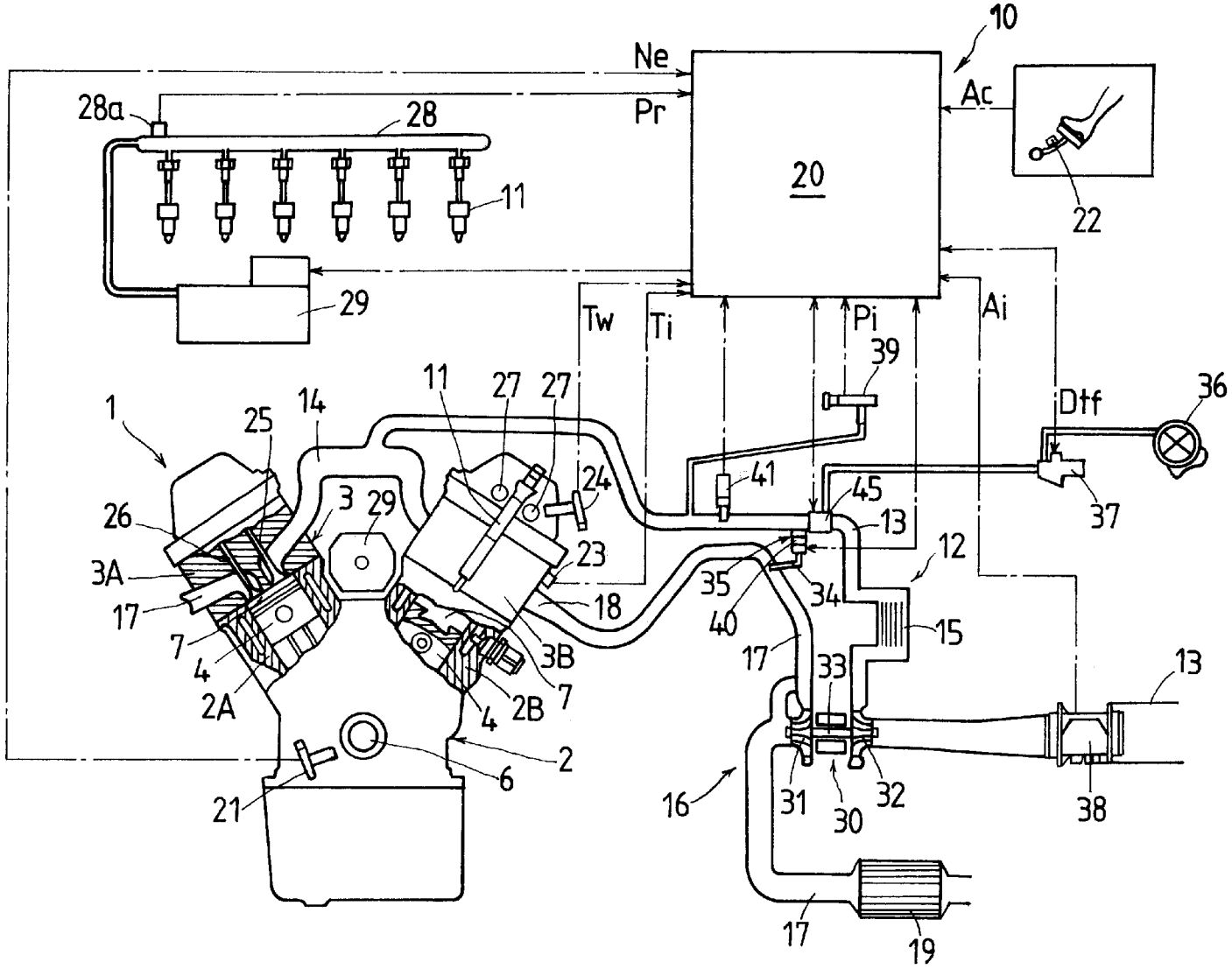
FIG. 4 is a schematic illustration of a preferred embodiment of the diesel engine to which is applied the engine-stop control system.

Referring first to FIG. 4, the following explains a preferred embodiment of the diesel engine to which is applied the engine-stop control system in accordance with the present invention.

While there is shown in FIG. 4 a pair of cylinders arranged in sidewise opposed banks 2A, 2B and each having a combustion chamber 7, a piston 4 and an fuel injector 11, a diesel engine 1 is a V-type direct-injection four-cycle multi-cylinder engine having, for example, six cylinders set in two banks of three cylinders each, which are arranged in a direction perpendicular to the paper. The diesel engine 1 is comprised of a cylinder block 2 having the two banks 2A, 2B, and cylinder heads 3 mounted to the banks 2A, 2B each to each bank. The pistons 4 are allowed to move up and down in cylinder liners fitted in cylinder bores formed in the banks 2A, 2B. Reciprocating motion of the pistons 4 is converted to rotating motion of a crankshaft 6 through connecting rods, not shown.

In an electronic fuel-injection system 10 for the diesel engine 1, while injectors 11 are arranged on the cylinder heads 3A, 3B, each to each head, FIG. 4 shows the injectors on only the cylinder head 3B. The injectors 11 each are an injector in which an injector body made at a distal end thereof with orifice through which fuel is injected into the cylinder is united with an solenoid-operated actuator to control the start and the end of fuel injection. The injectors 11 are operated under hydraulic force of a working fluid of fuel or engine oil to directly inject the fuel into combustion chambers 7 with fuel-injection conditions such as fuel-injection timing, an amount of fuel to be injected, and so on, which are found on a mapped data stored previously, depending on requirements to operate the diesel engine. The fuel charged into the combustion chambers ignites from contact with hot admitted air, which is compressed by the pistons 4 moving upwards in the combustion chambers 7.

The electronic fuel-injection system 10 is controlled by a electronic control unit 20, which is applied with sensing signals issued from diverse sensing means monitoring the operating conditions of the diesel engine 1. The electronic control unit 20, on the basis of the signals reported from the sensing means, regulates the injectors 11, especially, solenoid-operated actuators, and a fuel-supply pump 29 installed in a fuel-supply system and further controls exhaust-gas recirculation in an intake system, which will be described hereinafter.

The electronic control unit 20 is moreover applied with signals issued from diverse sensing means: a crankshaft-position sensor for detecting the rpm Ne of the engine 1, which is composed of a crankshaft sensor such as a pickup-coil assembly or an optical rotary encoder, and so on, to sense a slotted timing disc fixed to the crankshaft 6 to rotate together and provided around thereof with notches, an accelerator pedal sensor 22 for detecting the depression Ac of an accelerator pedal or the opening of a throttle valve, a temperature sensor 23 for monitoring a temperature Tw of coolant circulating through the cylinder head 3 or an oil-temperature sensor for detecting a temperature of lubricating oil, and a cam sensor 24 provided on the cylinder head 3 to sense angular positions of a camshaft 27 on which cams are mounted to operate intake valves 25 and exhaust valves 26.

The electronic control unit 20 regulates conduction timing and conductive duration of a control current applied to the solenoid-operated actuators in the injectors 11, thereby controlling an injection timing and an amount of fuel to be injected per a combustion cycle. On the basis of a fundamental amount of fuel to be injected, which is equivalent to a desired value derived from the engine operating requirements, the electronic control unit 20 finds a conductive period, or a pulse width, applied to the solenoid-operated actuator, during which the actuator is energized to control the amount of fuel injected per a combustion cycle. The timing for starting the conduction and the conductive duration of a driving current to energize the solenoid-operated actuator are controlled depending on crankshaft position sensed by the crankshaft-position sensor 21 as well as other signals reported from various sensors, which monitor such event that the piston 4 in the standard cylinder or the individual cylinders has reached top dead center of the compression phase or a preselected position just before the end of the compression phase. The fuel delivered from the fuel-supply pump 29 is stored in a common rail 28 under high pressure.

The electronic control unit 20 is furthermore applied with a signal reported from a pressure sensor 28*a* to monitor a pressure Pr in a common rail 28. Thus, the electronic control unit 20 controls an amount of fuel forced out of the fuel-supply pump 29 to the common rail 28 so as to either recover a pressure drop caused in the common-rail pressure Pr owing to the fuel injection out of the injectors 11 or keep the common-rail pressure Pr optimal in response to the engine operating requirements.

In an intake system 12 for the diesel engine 1, an intake-air passage 13 flowing the air drawn in from the atmosphere is connected with the diesel engine 1 through an intake manifold 14, which is opened to the combustion chambers 7 via the intake valves 25 and intake ports. The intake-air passage 13 is provided therein with an intercooler 15 to cool down the intake air, which is thus improved in charging efficiency. In an exhaust system 16, an exhaust duct 17 for discharging exhaust gases to the atmosphere is communicated with the diesel engine 1 through an exhaust manifold 18, which is opened to the combustion chambers 7 via the exhaust valves 26 and exhaust ports. The exhaust duct 17 has therein exhaust-gas cleaning means 19 and/or a regenerator to recover the energy in the exhaust gases.

Between the intake system 12 and exhaust system 16 there is provided a supercharger 30 having a controllable nozzle turbine 31. The supercharger 30 is composed of the turbine 31 arranged on the side of the exhaust system 16 and having turbine blades driven with the hot exhaust gases, a compressor 32 arranged on the side of the intake system 12 and driven from the turbine 31 to compress the intake air, and a shaft 33 to interconnect the turbine 31 and the compressor 32 with each other.

Both the air-intake passage 13 and the exhaust duct 17 for the engine 1 are intercommunicated with a passage 34 for exhaust-gas recirculation, which is commonly abbreviated to EGR, to circulate again a small metered amount of the exhaust gases back into the intake-air passage 13 to reduce the formation of NOx. The EGR passage 34 is provided with an EGR valve for opening and blocking off the EGR passage 34, thereby controlling the amount of exhaust gases circulated again. Valve lift to determine opening degrees of the EGR valve 35 is controlled by a pressure-regulating valve, not shown, which is regulated by the electronic control unit 20 to determine a rate of partial vacuum developed by a vacuum pump, not shown, which is to be introduced into the EGR valve 35.

A mass airflow sensor 38 for monitoring an amount Ai by weight of air flowing through the intake-air passage 13 is installed in the intake-air passage 13 at a location upstream of the supercharger 30. Although but the mass airflow sensor 38 has been explained just above as the type of measuring the amount of air by weight, it will be appreciated that the type of measuring the amount of air by volume is available. In the latter type, an intake temperature sensor 41 for monitoring an intake temperature Ti is provided to find the amount Ai of intake air on the basis of a volume of air and the intake temperature Ti. A boost-pressure sensor 39 for monitoring an intake pressure Pi is arranged in the intake-air passage 13 at a location downstream of an egress of the EGR passage 34, which is opened to the intake-air passage 13 at a specified position downstream of the supercharger 30. The electronic control unit 20 is signaled with the amount Ai of intake air detected at the mass airflow sensor 38 and the intake pressure Pi detected at the boost-pressure sensor 39.

A partial vacuum sensor 40 for EGR is to detect a partial vacuum causing the valve lift of the EGR valve 35. The electronic control unit 20 is further applied with signals reported from a throttle-position sensor for an intake-throttle valve 45. Valve lift to determine the position of the throttle valve 45, as in the EGR valve 35, is controlled by a pressure-regulating valve 37, which is actuated to vary a proportion of partial vacuum developed by a vacuum source or a vacuum pump 36, which is to be introduced into the intake-throttle valve 45. Although but an atmospheric pressure sensor may be installed separately, the partial vacuum sensor 40 for EGR in the embodiment described here serves common to the atmospheric pressure sensor. That is to say, the partial vacuum sensor 40, when the EGR is activated, detects the operating pressure for the EGR valve 35, but when no EGR operates, serves as the atmospheric-pressure sensor.

In the controllable nozzle turbine 31 for the supercharger 30, the control of the gas velocity to the turbine blades with a variable throttle nozzle makes it possible to drive the compressor 32 even when the engine operates with considerably low speeds, raising the intake pressure. The less the lift operating the controllable nozzle vanes is, the smaller is the effective opening area of the throttled nozzle, with the work exerted on the turbine increasing. This causes a tendency to increase the amount of air pressurized by the compressor, thus elevating the intake pressure.

Figure 1:
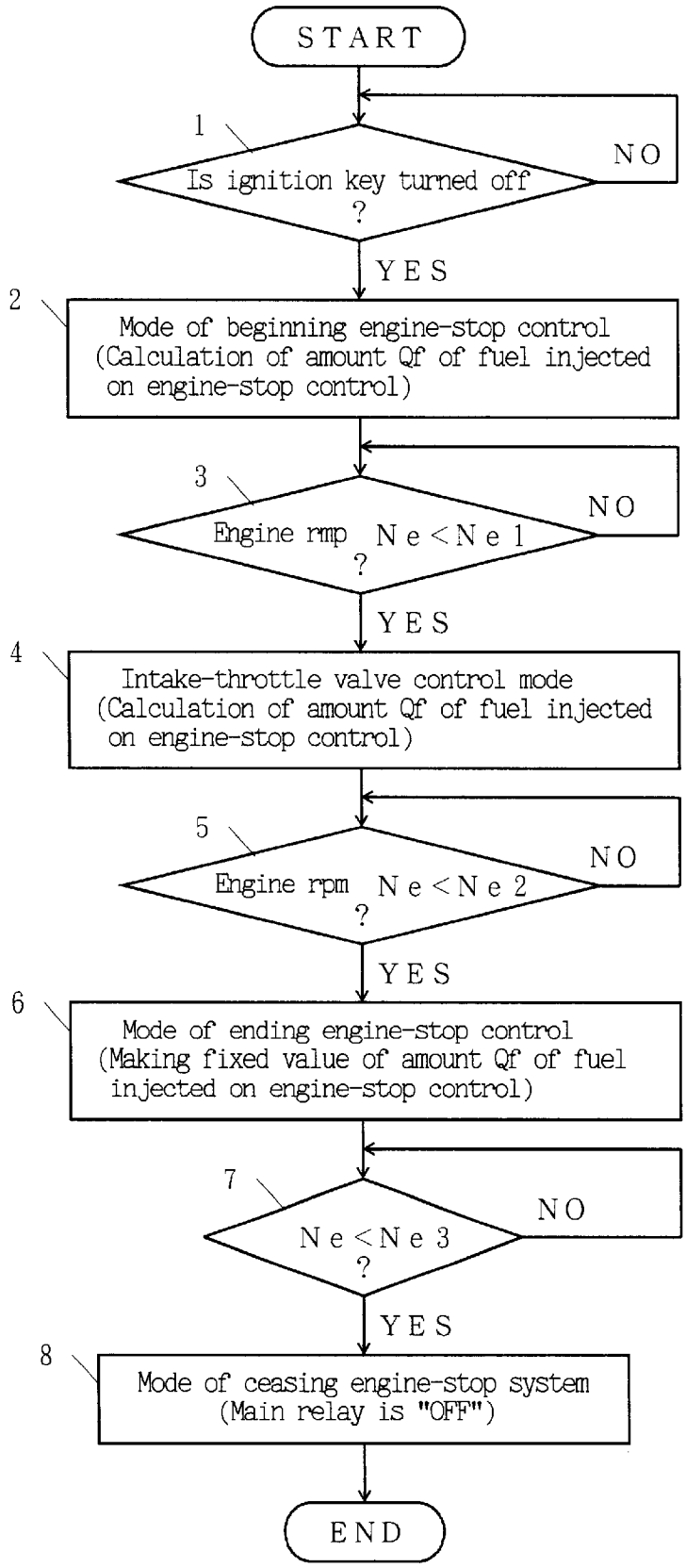
FIG. 1 is a flowchart illustrating a preferred embodiment of a main routine procedure for engine-stop control of diesel engines in accordance with the present invention.

Referring now to flowcharts and block diagram, the following will explain the engine-stop control system in accordance with the present invention. The flowchart in FIG. 1 illustrates a main routine procedure of from the beginning to the final of the engine-stop control inclusive, and explains the flow of open-loop control system for the engine-stop control.

Identification of turning from "ON" to "OFF" of the ignition key, which is manipulated for starting and stopping the diesel engine 1 (Step 1). What the ignition key is turned off signals the electronic control unit 20 to transfer an engine control mode from an engine-operating mode to an engine-stop control mode.

On the engine-stop control mode, the engine control system first enters a mode of beginning the engine-stop control, where calculation is performed to find a reduction Qd for the engine-stop in amount of fuel injected (Step 2). The reduction Qd in amount of fuel injected have tended to increase with time T that has elapsed since the ignition key was turned off. Accordingly, an amount Qf of fuel injected at the engine-stop on the mode of beginning the engine-stop control will be found by subtracting the reduction Qd in amount of fuel injected from an amount Qfs of fuel injected in an early stage of the engine-stop control at an instant the mode of beginning the engine-stop control starts: $Qf=Qfs-Qd$. It will be thus understood that the amount Qf of fuel will reduce with the elapsed time T and a corresponding decrease in the engine rpm. In the mode of beginning the engine-stop control, the EGR valve 35 is closed and an acceleration pedal is released fully, so that adjustment on idle speed ceases and the intake-throttle valve remains open partially and the duty ratio is kept at "ON".

Next, identifying whether the engine rpm Ne reduces below a preselected engine rpm Ne1 as the result of the performance of the mode of beginning the engine-stop (Step 3). When the engine rpm Ne becomes less than the preselected engine rpm Ne1, the electronic control unit 20 enters an intake-throttle valve control mode, where calculation is performed to find a reduction Qd in amount of fuel injected on the intake-throttle valve control mode (Step 4).

Identification of whether the engine rpm further falls below another preselected engine rpm Ne2 (Step 5). The amount Qf of fuel injected on the engine-stop control, common-rail pressure Pr and fuel-injection timing are controlled so as to diminish at a preselected value with time until the engine rpm Ne descends to the Ne2. With the engine rpm Ne becoming less than the preselected value Ne2, the electronic control unit 20 enters a mode of ending the engine-stop control (Step 6). On this mode of ending the engine-stop control, the intake-throttle valve 45 is completely closed by, for example, setting the duty ratio of 100%. With the complete closure of the intake-throttle valve 45, the fresh-air supply to the combustion chamber ceases and, therefore, no pressure rise in the combustion chamber results in suppressing the occurrence of vibration in the engine. The amount Qf of fuel injected on the engine-stop control, common-rail pressure Pr and fuel-injection timing are set to fixed values, respectively, at the instant the engine rpm Ne reaches the rpm Ne2. The fixed values at this time are set to values on the intake-throttle valve control mode shortly before the engine rpm Ne reaches the Ne2.

Identification of whether the engine rpm Ne has fallen below a further another rpm Ne3 that is lower than the value Ne2 (Step 7). That is, whether the engine operation ceases actually is identified. When the engine has been stopped absolutely, the electronic control unit 20 terminates the engine-stop control mode to enter a mode of ceasing the engine-stop system (Step 8), where a main relay for engine control is switched off.

As apparent from the foregoing, according to the engine-stop control system of this invention, the fuel supply does not cease immediately the instant the ignition key is turned from "ON" to "OFF", but still continues injecting fuel into the combustion chambers 7 for a preselected interval of time with the amount Qf injected on the engine-stop control mode, which reduces gradually with the time T that has elapsed since the ignition key was turned off. Thus, the combustion is allowed to continue for a preselected interval of time after the ignition is off. Slow reduction of the engine rpm Ne may lessen the vibrations or chocks that would otherwise result from sudden stop occurring conventionally in the diesel engine 1.

Figure 2:
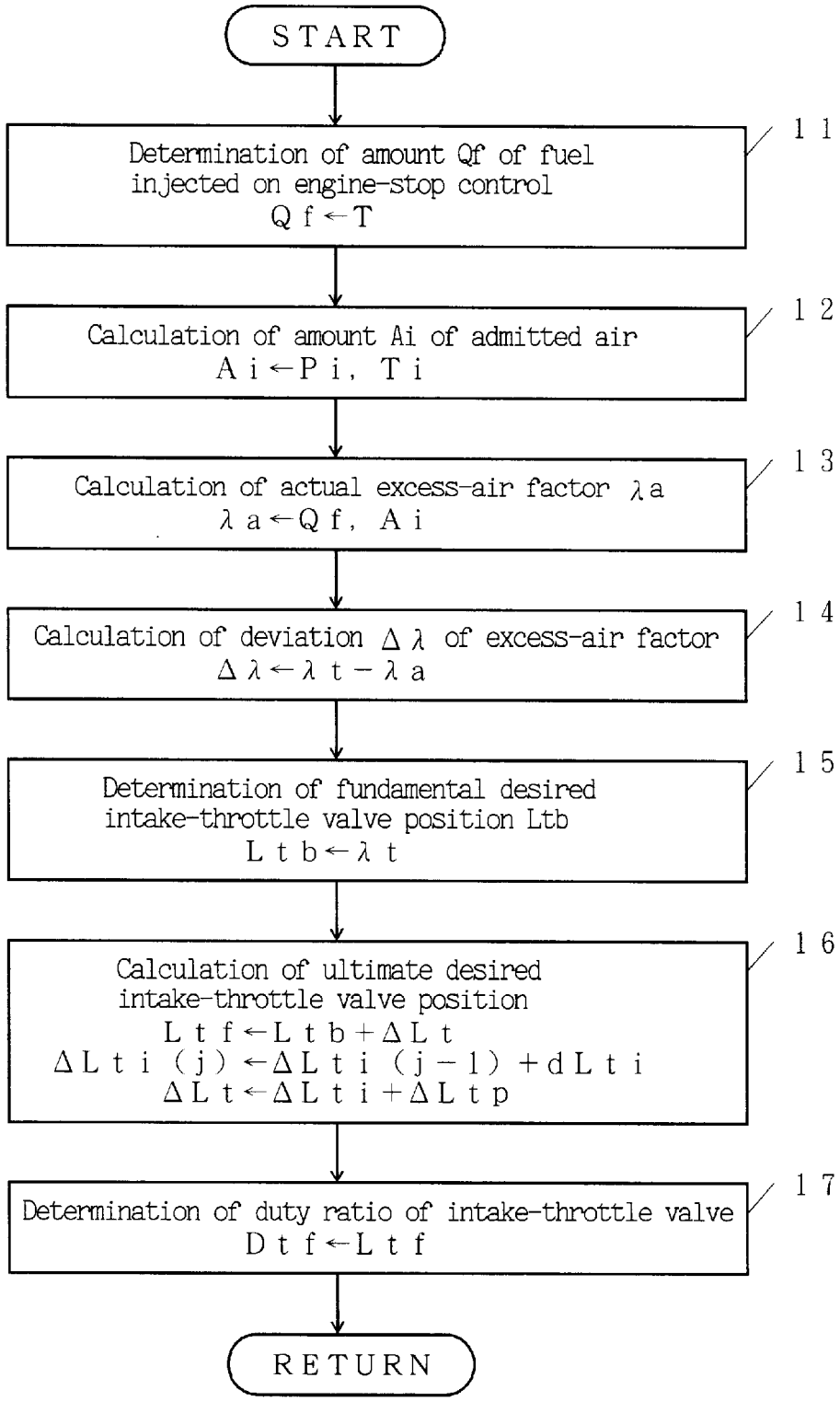
FIG. 2 is a flowchart illustrating a preferred embodiment of a control routine procedure executed in an intake-throttle valve control mode of the flowchart in FIG. 1.
Figure 3:
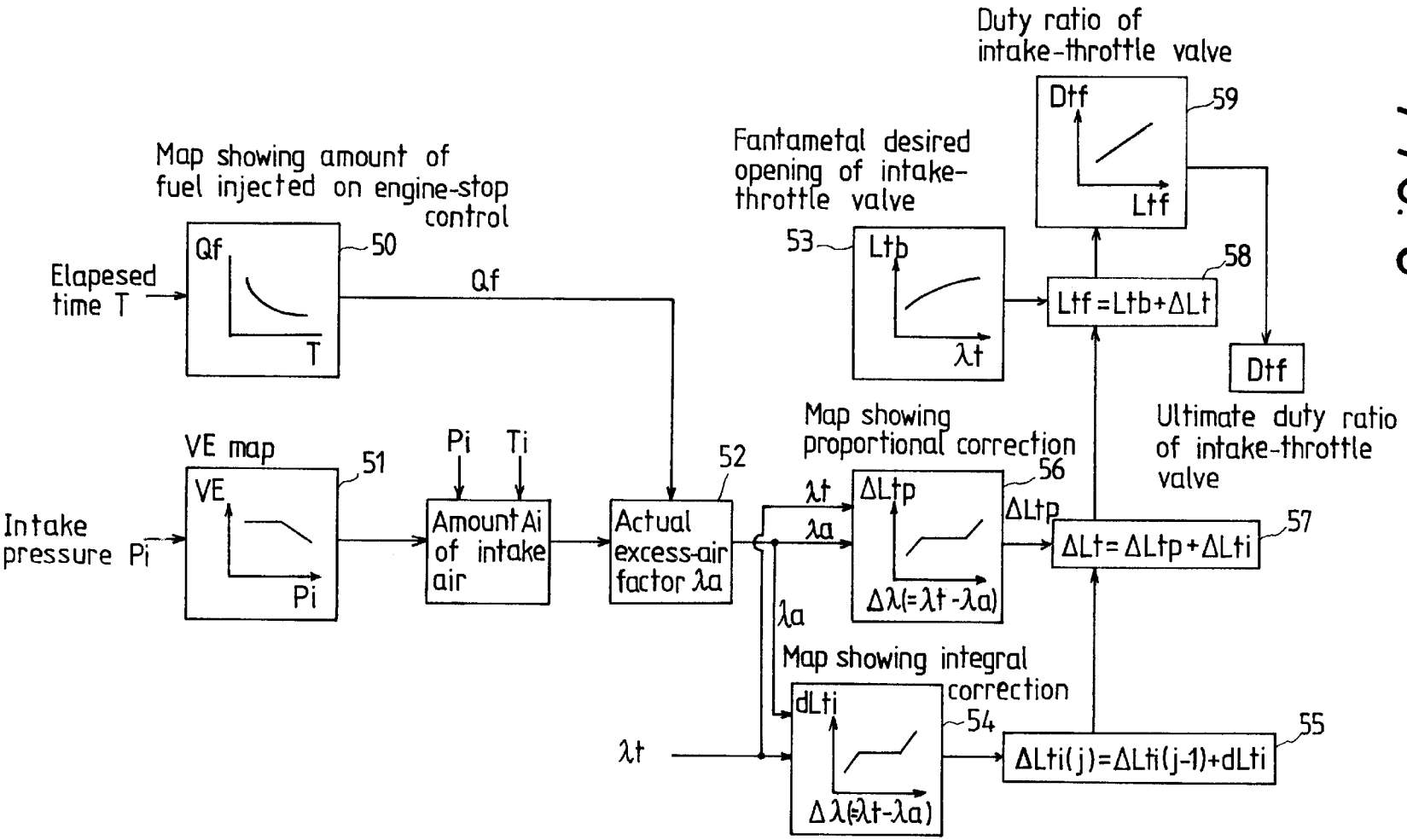
FIG. 3 is a block diagram illustrating a preferred embodiment of a detailed control routine procedure in the intake-throttle valve control mode shown in FIG. 2.

Referring now to the block diagram of FIG. 2 and the flowchart of FIG. 3, the intake-throttle valve control mode will be explained in detail.

The intake-throttle valve control mode starts when the engine rpm Ne drops below the preselected value Ne1 of rpm as the result of the performance of the mode of beginning the engine-stop control. Means 50 determines the amount Qf of fuel injected on the engine-stop control will be found by subtracting the reduction Qd in amount of fuel injected, which increases with that time T that has elapsed since the ignition key was turned from "ON" to "OFF", from the amount Qfs of fuel injected in an early stage of the engine-stop control (Step 11). As an alternative, the amount Qf of fuel injected on the engine-stop control may be found on the basis of a map showing the amount of fuel injected on the engine-stop control, as shown in FIG. 3, in which the relation of the elapsed time T with the amount Qf of fuel injected on the engine-stop control has been previously given in the form of a function lowering with time.

Means 51 determines the amount Ai of intake air on the basis of both the intake-air pressure Pi derived from the signals of boost-pressure sensor 39 and the intake-air temperature Ti found on the signals issued from the intake-air temperature sensor 41 (Step 12). That is to say, volumetric efficiency VE is first obtained from the intake-air pressure Pi. Then, an estimated amount Ai of intake air is found on the resultant volumetric efficiency VE, sensed intake-air pressure Pi and intake-air temperature Ti, according to the following equation $$Ai=Vc(cc/cyl)\times VE\times \rho o\times (Pi/Ti)\times (To/Po)\times 10^{-6}(kg/cyl)$$

wherein Vc is volume of intake air per cylinder, ρo is air density, which is 1.184 kg/m$^3$ at the standard condition, Po and To are air pressure and temperature at the standard condition.

As an alternative, the amount Ai of intake air may be a value that is issued from the mass airflow sensor 38 arranged at the specified position downstream of the intake-throttle valve 38.

Means 52 finds actual excess-air factor λ a on the basis of both the amount Qf of fuel injected on the engine-stop control given at the step 11 and the amount Ai of intake air obtained at the step 12 (Step 13). The actual excess-air factor λ a is expressed as a ratio of an actual air-fuel mixture ratio to the stoichiometric ratio. Less excess-air factor λ, as the mass of air is small, is apt to develop much smoke.

Calculation of a deviation Δλ of the actual excess-air factor from a desired excess-air factor λt found on the engine rpm Ne (Step 14). Means 53 determines a fundamental desired intake-throttle valve position Ltb in compliance with the desired excess-air factor λt (Step 15). The fundamental desired intake-throttle valve position Ltb, although employing the value determined according to the desired excess-air factor λt in the embodiment explained here, may be replaced with a fixed value.

A correction amount ΔLt of the desired intake-throttle valve position Lt is found by PI control or proportional plus integral action control, depending on the deviation Δλ of excess-air factor. Then, the correction amount ΔLt of the intake-throttle valve position is added to the fundamental desired intake-throttle valve position Ltb obtained at the above step 15 to thereby find an ultimate desired intake-throttle valve position Ltf (Step 16). That is to say, the correction amount ΔLt of the intake-throttle valve position is dependent on the deviation Δλ of excess-air factor and defined as the sum of an integral correction ΔLti and a proportional correction ΔLtp of the desired intake-throttle valve position Lt.

There is provided a mapped data 54 that has been previously found on the correlation between the deviation Δλ of excess-air factor and an increment dLti of the integral correction. The recent integral correction ΔLti(j) of the desired intake-throttle valve position may be determined by adding the increment dLti of the integral correction, which is derived from the mapped data 54 depending on the recent deviation Δλ of excess-air factor, to the last integral correction ΔLti(j−1), or defined as $$\Delta Lti(j)=\Delta Lti(j-1)+dLti \qquad \text{equation 55}$$

On the other hand, a mapped data 56 has been found previously about the correlation between the deviation Δλ of excess-air factor and the proportional correction ΔLtp. Thus, the proportional correction ΔLtp of the desired intake-throttle valve position Lt may be found on the mapped data 56, depending upon the recent deviation Δλ of excess-air factor. Adding the integral correction ΔLti obtained according to the equation 55 and the proportional correction ΔLtp determined on the mapped data 56 results in the correction amount ΔLt of the intake-throttle valve position.

$$\Delta Lt=\Delta Lti+\Delta Ltp \qquad \text{equation 57}$$

As an alternative, the proportional correction ΔLtp may be defined as the product of the deviation Δλ of excess-air factor and proportionality coefficient Kp, while the integral correction ΔLti may be the product of the integral of the deviation Δλ of excess-air factor, or ∫Δλ, and integral coefficient Ki.

The ultimate desired intake-throttle valve position Ltf may be calculated according to the equation 58, where the correction amount ΔLt of the intake-throttle valve position obtained from the above equation 57 is added to the fundamental desired intake-throttle valve position Ltb, which is determined at means 53 depending upon the desired excess-air factor λt, thereby correcting the fundamental desired intake-throttle valve position Ltb.

$$Ltf=Ltb+\Delta Lt \qquad \text{equation 58}$$

Means 59 for determining duty ratio Dtf of the intake-throttle valve is further provide, which has a previously-stored mapped data of correlation between the ultimate desired intake-throttle valve position Ltf and the duty ratio Dtf for defining throttling positions of the intake-throttle valve 45. The duty ratio Dtf of the solenoid-operated intake-throttle valve 45 is determined depending on the ultimate desired intake-throttle valve position Ltf found at the above step 16 (Step 17). The control routine described above terminates when the engine rpm become below a preselected value, for example, 300 rpm.

On stopping the diesel engine 1, according to the present invention as described above, the amount Qf of fuel injected on the engine-stop control is made reduced slowly with the time T that has elapsed since the ignition is off, and determined at a small amount compared with the amount of fuel injected on normal engine operation. Nevertheless, the intake-throttle valve is actuated to move to the narrow-open position to lower the amount of admitted air correspondingly to the reducing amount Qf of fuel injected on the engine-stop control, thereby keeping the combustion chambers 7 from excess-air event. This makes it possible to slow the engine rpm down gradually, with continuing good burning of fuel in the combustion chambers 7 without causing sudden stall of the engine. Moreover, the open position of the intake-throttle valve 45 is controlled to bring the actual excess-air factor λ a in coincidence with the desired excess-air factor λt, so that the amount of admitted air metered accurately corresponding to the amount Qf of fuel injected on the engine-stop control is allowed to flow in the combustion chambers 7, thus helping ensure the steady combustion.

What is claimed is:

1. A diesel engine control system on engine-stop, comprising an operating means turned over between an "ON"-position where the diesel engine operates and an "OFF"-position where the diesel engine stops, sensing means for monitoring diesel engine operating conditions, a fuel-injection mechanism for injecting fuel into a combustion chamber in the diesel engine, a controller for determining an amount of fuel to be injected depending upon the diesel engine operating conditions, wherein the controller has an engine-stop control mode which is functionable after the operating means is turned to "OFF"-position, and the controller decreases the amount of fuel to be injected gradually with a time that has elapsed after starting of the engine-stop control mode.

2. A diesel engine control system on engine-stop as defined in claim 1, wherein an intake-throttle valve is provided in the diesel engine to regulate an amount of air admitted into the combustion chamber, and the controller makes the intake-throttle valve narrower in throttling position gradually with a time that has elapsed after starting of the engine-stop control mode.

3. A diesel engine control system on engine-stop as defined in claim 2, wherein the controller finds the amount of air admitted into the combustion chamber in accordance with Signals reported from the sensing means, and an actual excess-air factor on the engine-stop control mode correspondingly to the amounts of fuel injected and air admitted, thereby controlling the throttling position of the intake-throttle valve to make the actual excess-air factor coincident with a desired excess-air factor that is determined depending on the signals from the sensing means.

4. A diesel engine control system on engine-stop as defined in claim 3, wherein the controller finds a fundamental desired intake-throttle valve position in accordance with the desired excess-air factor, and a correction amount of the intake-throttle valve position depending on a deviation of the actual excess-air factor from the desired excess-air factor, and further compensates the fundamental desired intake-throttle valve position with the correction amount of the intake-throttle valve position, thereby finding an ultimate desired intake-throttle valve position, on the basis of which is regulated the intake-throttle valve position.

5. A diesel engine control system on engine-stop as defined in claim 4, wherein the controller provides the correction amount of the intake-throttle valve position, which is expressed as a sum of an integral correction and a proportional correction that are found depending on the deviation of the actual excess-air factor from the desired excess-air factor.

6. A diesel engine control system on engine-stop as defined in claim 1, wherein the controller closes completely the intake-throttle valve when the diesel engine rpm on the engine-stop control mode lowers below a preselected rpm, while maintaining the amount of fuel injected at a fixed value.

7. A diesel engine control system on engine-stop as defined in claim 2, wherein the controller closes completely the intake-throttle valve when the diesel engine rpm on the engine-stop control mode lowers below a preselected rpm, while maintaining the amount of fuel injected at a fixed value.

8. A diesel engine control system on engine-stop as defined in claim 3, wherein the controller closes completely the intake-throttle valve when the diesel engine rpm on the engine-stop control mode lowers below a preselected rpm, while maintaining the amount of fuel injected at a fixed value.

9. A diesel engine control system on engine-stop as defined in claim 4, wherein the controller closes completely the intake-throttle valve when the diesel engine rpm on the engine-stop control mode lowers below a preselected rpm, while maintaining the amount of fuel injected at a fixed value.

10. A diesel engine control system on engine-stop as defined in claim 5, wherein the controller closes completely the intake-throttle valve when the diesel engine rpm on the engine-stop control mode lowers below a preselected rpm, while maintaining the amount of fuel injected at a fixed value.

* * * * *